US006257148B1

(12) United States Patent
Toivonen et al.

(10) Patent No.: US 6,257,148 B1
(45) Date of Patent: Jul. 10, 2001

(54) ARRANGEMENT FOR SUPPORTING MORTAR SHELL INTO BARREL

(75) Inventors: Vesa Tapio Toivonen, Kokemäki; Kari Matti Reunamäki, Tampere; Martti Juleani Lehtimäki, Sarkola, all of (FI)

(73) Assignee: Patria Vammas Oy, Vammala (FI)

( * ) Notice: Subject to any disclaimer, the term of this patent is extended or adjusted under 35 U.S.C. 154(b) by 0 days.

(21) Appl. No.: 09/341,423

(22) PCT Filed: Jan. 23, 1998

(86) PCT No.: PCT/FI98/00064

§ 371 Date: Aug. 23, 1999

§ 102(e) Date: Aug. 23, 1999

(87) PCT Pub. No.: WO98/33018

PCT Pub. Date: Jul. 30, 1998

(30) Foreign Application Priority Data

Jan. 24, 1997 (FI) ..... 970313

(51) Int. Cl.[7] ..... F42B 15/00; F42B 5/02; F42B 30/08

(52) U.S. Cl. ..... 102/439; 102/293; 102/372; 102/469; 102/483

(58) Field of Search ..... 102/372–374, 102/376, 380, 430, 439, 445, 469, 470, 293, 483

(56) References Cited

U.S. PATENT DOCUMENTS

| | | | | |
|---|---|---|---|---|
| 2,657,630 | * | 11/1953 | Blacker | 102/372 |
| 2,777,391 | * | 1/1957 | McNally | 102/376 |
| 2,872,864 | * | 2/1959 | Barnes et al. | 102/439 |
| 3,326,128 | * | 6/1967 | Choate | 102/376 |
| 3,922,962 | * | 12/1975 | Mertens | 102/439 |
| 4,815,387 | * | 3/1989 | Lubbers | 102/439 |
| 4,887,534 | * | 12/1989 | Dickovich et al. | 102/439 |
| 5,503,080 | | 4/1996 | Goward | 102/293 |

FOREIGN PATENT DOCUMENTS

| | | | | |
|---|---|---|---|---|
| 74385 | * | 12/1944 | (CZ) | 102/373 |
| 83002 | * | 3/1935 | (SE) | 102/373 |
| WO 88/08510 | * | 11/1988 | (WO) | 102/439 |
| 9635094 | | 11/1996 | (WO) . | |

* cited by examiner

*Primary Examiner*—Harold J. Tudor
(74) *Attorney, Agent, or Firm*—Ladas and Parry

(57) ABSTRACT

The invention relates to an arrangement for supporting a mortar shell into the barrel of a mortar weapon by using a separate support piece fixed to the tail of the mortar shell. In the arrangement the support piece is attached to the tail of the mortar shell with a mechanical joint provided by a separate connecting element (7), the connecting element being manufactured of such material and constructed in such a way that it fractures when the charge of the mortar shell is fired, allowing the mortar shell (1) to detach from the support piece (8).

11 Claims, 2 Drawing Sheets

ARRANGEMENT FOR SUPPORTING MORTAR SHELL INTO BARREL

FIELD OF THE INVENTION

The invention relates to an arrangement for supporting a mortar shell in the barrel of a breech-loading mortar weapon, said arrangement comprising a support piece, with a rim flange, to be attached to the tail of the mortar shell.

BACKGROUND

A problem with mortars used on different armored self-propelled chassis concerns the ability of the device to defend itself. If a heavy mortar is mounted on a chassis, it is not usually easy to mount on it sufficiently heavy artillery weapons for defense purposes. Lighter automatic weapons, on the other hand, are not always sufficient against antitank equipment or other artillery at a longer distance. In some cases it would be necessary to have the possibility to fire a smooth-bore mortar also horizontally with direct fire, which is not normally possible. Any movement of the shell in the barrel can also cause the shell not to go off when needed. One solution to this problem is proposed in the U.S. Pat. No. 5,503,080, in which a separate guiding and attachment element is used in the tail of a mortar shell. Said solution includes a separate guiding element furnished with grooves dimensioned according to the tail of the shell, the tail being pushed into the grooves in such a way it is attached to the guiding element with a friction joint. A problem with this solution is that the fastening of the support piece is not reliable during handling, the operational reliability of the shell being thus insufficient. The application of said solution also requires very precise measures of the tail of the shell and its support piece, in order for the shell to function at least somewhat reliably.

SUMMARY OF THE INVENTION

An object of the present invention is to provide an arrangement which enables a mortar shell to be held securely and reliably in a correct position in a barrel of a breech-loading mortar weapon and ensures its reliable and secure operation under all circumstances.

An arrangement of the invention is characterized in that said arrangement comprises, between a support piece and the tail of a mortar shell, a connecting element providing a mechanical joint, which enables the support piece to be attached to the tail of the mortar shell, and that the support piece includes a firing member, with which the actual primer can be fired to discharge the mortar shell.

An essential idea of the invention is that the support piece is arranged to the shell with a mechanical joint, such as a thread or the like, provided by a separate connecting element, which is of such material and structure that when the mortar shell is fired, the connecting element between the mortar shell and the support piece fractures. Another essential idea of the invention is that the support piece comprises a firing member, which transfers the firing of the weapon to the primer of the mortar shell.

An advantage of the invention is that after the support piece is connected to the mortar shell, the joint between them is firm and holds the mortar shell reliably and securely in place in a correct position in the barrel of the weapon, irrespective of the position of the barrel. Another advantage of the invention is that it allows using existing mortar shells without changes made to the mortar shell itself or to the charging system. A further advantage of the invention is that the support piece is light and inexpensive. One more advantage of the invention is its convenience of use in sliding breech lock wedge type based solutions, in which the sealing and the firing of the mortar shell would be problematic.

BRIEF DESCRIPTION OF THE DRAWINGS

The invention will be described in greater detail with reference to the attached drawings, in which.

DETAILED DESCRIPTION

Figure 1:
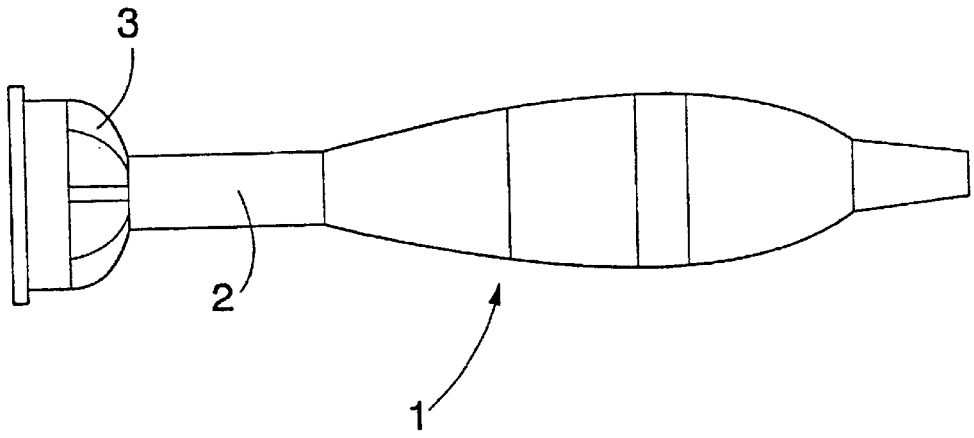
FIG. 1 is a schematic view of an arrangement of the invention arranged to a mortar shell and FIGS. 2*a*–2*c* are schematic, enlarged and partly cross-sectional views of embodiments of an arrangement of the invention.

FIG. 1 is a schematic view of a mortar shell 1, known per se, comprising a tail tube 2. At the rear end of the tail tube 2 there are fins 3, which guide the flight of the mortar shell. Their structure and construction are commonly known per se, so their previously known embodiments need not be clarified in greater detail.

Figure 2A:
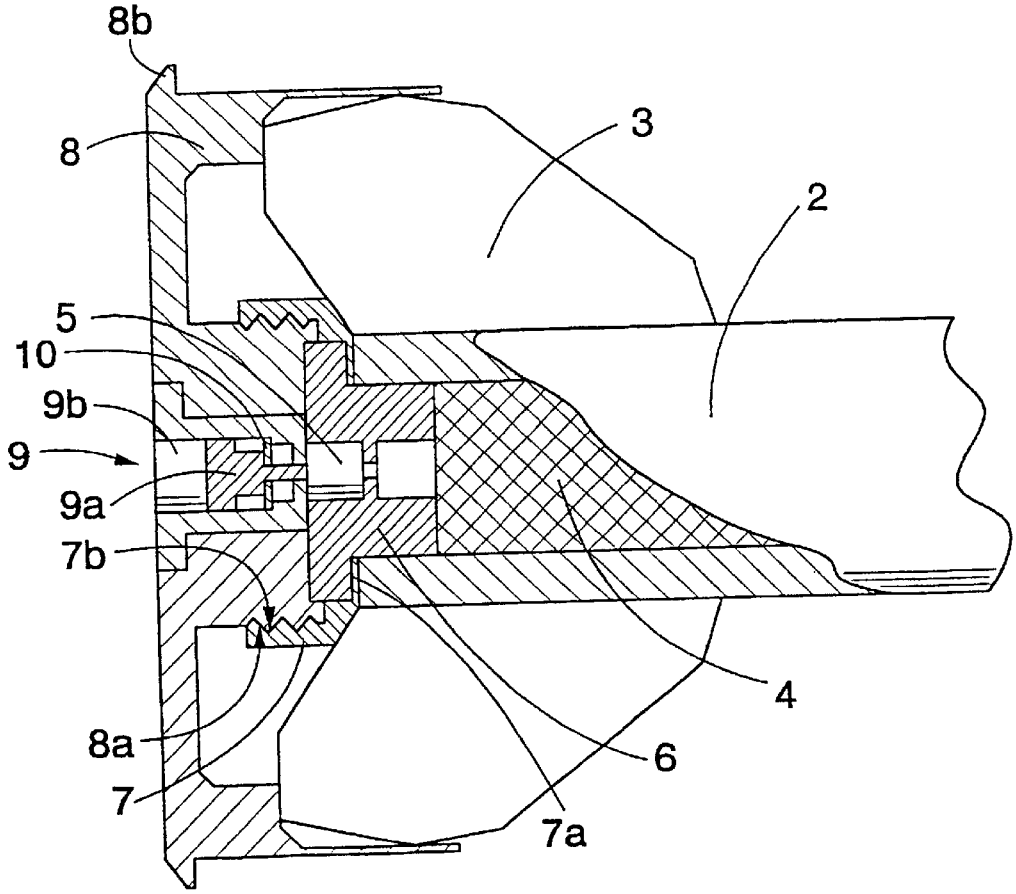

FIG. 2*a* shows a schematic, partly cross-sectional view of an embodiment of an arrangement of the invention. The tail tube 2 of the mortar shell contains a propelling charge 4, which is used to expel the mortar shell from the barrel. For the firing of the propelling charge 4, a primer 5 is arranged at the end of the tail tube 2 with a separate attachment piece 6 provided with threads. Normally, when a mortar is used to fire mortar shells, the firing pin of the mortar strikes a primer 5 which fires the propelling charge 4, thereby expelling the mortar shell from the barrel.

The Figure also shows a separate connecting element 7 with a thin flange 7*a*. The flange 7*a* is located between the tail tube 2 and the attachment piece 6 in such a way that the attachment piece 6 attaches the connecting element 7 to the mortar shell. The connecting element 7, in turn, has a thread 7*b*, to which a separate support piece 8 is attached with a corresponding thread 8*a*. The support piece 8 resembles a short case end with a cylinder part extending around the fins 3 in such a way that when the mortar shell is in the barrel of the weapon, it is in a substantially direct and central position parallel to the barrel. The support piece also has a rim flange 8*b*, which sets in a groove at the rear part of the weapon's barrel, holding the mortar shell in a correct position in the barrel, irrespective of the position of the barrel, at the same time as the cylinder part seals the barrel. The support piece 8 further includes a firing member 9, which in this embodiment comprises an intermediate firing pin 9*a* and an electrical primer 9*b*. The intermediate firing pin 9*a* is normally kept in its place by a separate closing plate or a similar locking member 10, which prevents the intermediate firing pin from moving until the electrical primer is fired, after which it yields so as to enable the intermediate firing pin to strike the primer 5 of the mortar shell and thereby fire the propelling charge 4 of the mortar shell. As the propelling charge of the mortar shell is fired, the flange 7*a* of the connecting element 7 fractures and comes off the connecting element and the mortar shell is expelled from the barrel while the support piece 8 and a major part of the connecting element 7 stay in place. Instead of an electrical primer, it is naturally possible to use a conventional primer, which the weapon's firing pin strikes upon discharging, thereby firing, with the intermediate firing pin 9*a*, the primer 5 of the mortar shell.

Figure 2B:
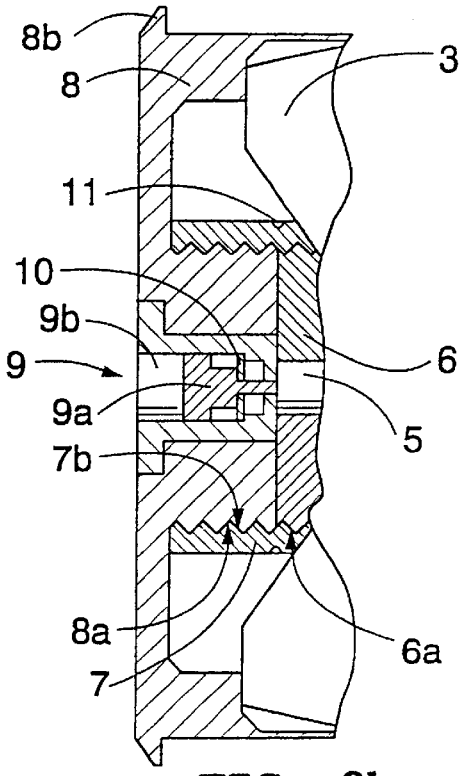

FIG. 2*b* shows another embodiment of an arrangement of the invention. In this embodiment the attachment piece 6 has a thread 6*a* on its outer surface. The support piece 8 correspondingly has on its outer surface a thread 8*a* with preferably the same dimensions. The connecting element 7 in this case is a sleeve-type element connecting the attachment piece 6 and the support piece 8 to each other. The connecting element 7 is in this case of such material that its threads 7*b* at the primer end of the attachment piece 6 fracture and come off or are deformed in such a way that the mortar shell is easily expelled when the charge is fired. If desired, the connecting element 7 can also be provided with a weakened section 11, where the connecting element 7 can fracture. This can also be used in a solution according to FIG. 1 and in other arrangements of the invention possibly implemented.

Figure 2C:
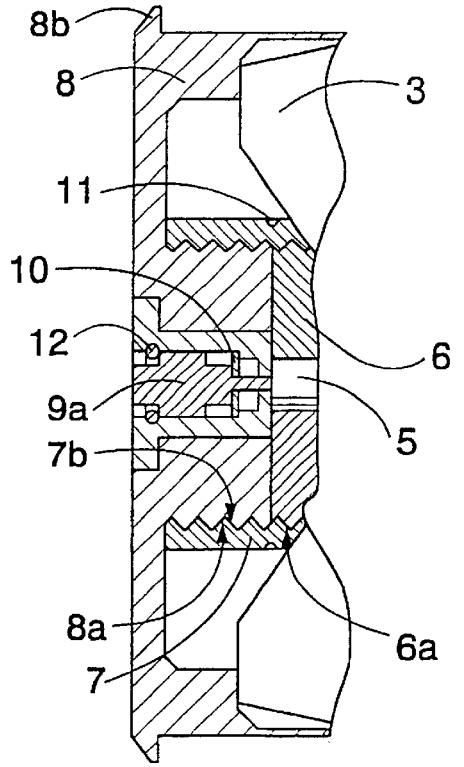

FIG. 2*c* shows a third embodiment of the invention, in which firing is not achieved using a separate primer. The firing member in this case only comprises the mechanical firing pin 9*a* without a separate primer, and the locking member 10 ensures that the pin is kept in place so that only when the firing pin of the weapon strikes the head of the intermediate firing pin 9*a*, it strikes the primer of the mortar shell, firing thus the charge of the mortar shell. The rear end of the intermediate firing pin 9*a* is in this case locked, e.g. with a locking ring 12 located in a groove behind the firing pin 9*a* and preventing it from falling from its place.

The above description and the drawings of the invention only represent an example of it, the invention not being restricted to it. Connecting elements can be shaped in different ways and manufactured of different materials, such as plastics, different composition metals, etc. An essential feature is that the support piece is attached to the mortar shell with a mechanical joint, preferably with a thread, in such a way that they are kept firmly together before the firing. It is also essential that as the mortar shell charge is fired, a part of the attachment piece fractures or is deformed in such a way that the mortar shell is detached from the support piece. Yet another essential feature is that the connecting element is strong enough to keep the support piece sufficiently firmly attached to the mortar shell during other handling of the mortar shell.

What is claimed is:

1. Apparatus for supporting a mortar shell in a barrel of a breech-loading mortar weapon, said apparatus comprising:

a support piece attachable to an end of the barrel of the breech-loading mortar to close said end, the mortar shell having a tail end with a tail tube including an attachment piece containing a primer to fire a propellant charge in the mortar shell, said attachment piece being attached at an end of the tail tube, said support piece including a firing mechanism for firing the primer in the mortar shell and thereby the propellant charge to fire the mortar shell from the barrel, and an attachment arrangement attachable to the attachment piece in the mortar shell and to the support piece in the barrel to enable the tail end of the mortar shell to be securely supported in the barrel, said attachment arrangement including a separable portion which separates when the propellant charge is fired and the mortar shell is fired from the barrel, said attachment arrangement being selectively attachable to the mortar shell to enable the mortar shell to be selectively used with or without the support piece and the attachment arrangement.

2. The apparatus as claimed in claim 1, wherein said attachment arrangement is threadably engageable with said support piece.

3. The apparatus as claimed in claim 1, wherein said attachment arrangement comprises a connecting element threadably engaged with said attachment piece.

4. The apparatus as claimed in claim 3, wherein said connecting element includes a region which is dimensioned to fracture when the mortar shell is fired.

5. The apparatus as claimed in claim 4, wherein said region in said connecting element is located so that when said region is fractured a part of the connecting element remains connected to the attachment piece and another part remains connected to said support piece.

6. The apparatus as claimed in claim 5, wherein said part of the connecting element which remains connected to the attachment piece comprises a thin flange secured between the attachment piece and the end of the tail tube of the mortar shell.

7. The apparatus as claimed in claim 3, wherein said connecting element comprises a sleeve threadably attached to said attachment piece and to said support piece.

8. The apparatus as claimed in claim 7, wherein said sleeve has a weakened section which fractures when the mortar shell is fired.

9. The apparatus as claimed in claim 7, wherein said sleeve is made of a material to fracture or be deformed where the sleeve is threadably attached upon firing of the mortar shell.

10. The apparatus as claimed in claim 1, wherein said firing mechanism comprises a separate intermediate firing pin; a closing member provided with a space in which the intermediate firing pin is movably supported to move to the primer in the mortar shell and fire the primer and a separate locking member for preventing the intermediate firing pin from moving towards the primer in the mortar shell, said locking member yielding or fracturing from the impact of a force on the intermediate firing pin allowing the intermediate firing pin to strike the primer.

11. The apparatus as claimed in claim 10, wherein said firing mechanism further comprises means for moving said firing pin to strike the primer.

* * * * *